US005126717A

United States Patent [19]

Renaud et al.

[11] Patent Number: 5,126,717

[45] Date of Patent: Jun. 30, 1992

[54] ELECTRONIC CRIBBAGE BOARD

[76] Inventors: John C. Renaud; Nancy R. Renaud, both of #4 - 20653 Thorne Avenue, Maple Ridge, British Columbia, Canada, V2X 8G2

[21] Appl. No.: 692,799

[22] Filed: Apr. 29, 1991

Related U.S. Application Data

[63] Continuation of Ser. No. 506,087, Apr. 9, 1990, abandoned.

[51] Int. Cl.[5] ..... A63F 1/18

[52] U.S. Cl. ..... 340/323 R; 273/237

[58] Field of Search ..... 340/323 R; 273/148 R, 273/DIG. 26, 237; 364/411; 235/90

[56] References Cited

U.S. PATENT DOCUMENTS

| | | | |
|---|---|---|---|
| 3,189,888 | 6/1965 | Bradley | 340/323 R |
| 3,905,547 | 9/1975 | Cyre et al. . | |
| 4,193,600 | 3/1980 | Armstrong et al. | 340/323 R X |
| 4,245,216 | 1/1981 | Rintoul | 340/323 R |
| 4,339,798 | 7/1982 | Hedges et al. | 340/323 R X |
| 4,968,030 | 11/1990 | Frymire | 364/411 |

FOREIGN PATENT DOCUMENTS

| | | | |
|---|---|---|---|
| 1120507 | 3/1982 | Canada . | |
| 1195001 | 10/1985 | Canada | 273/148 R |
| 8101766 | 6/1981 | PCT Int'l Appl. | 340/323 R |
| 2173406 | 10/1986 | United Kingdom | 273/148 R |

*Primary Examiner*—Jin F. Ng
*Assistant Examiner*—Brain R. Tumm
*Attorney, Agent, or Firm*—John Russell Uren

[57] ABSTRACT

An electronic cribbage board is provided which replaces the traditional pegs by LED's which light up to indicate each player's score. A keyboard for entering each player's score is provided which has a key for every possible score obtainable during the play of a cribbage hand. The score is entered by depressing a single key. Two LED's for each player are illuminated at the same time to present a present score and a previous score.

7 Claims, 2 Drawing Sheets

ELECTRONIC CRIBBAGE BOARD

This application is a continuation of U.S. patent application Ser. No. 07/506,087, filed Apr. 9, 1990,now abandoned.

INTRODUCTION

This invention relates to an electronic cribbage board.

BACKGROUND OF THE INVENTION

Cribbage is a card game which is played with a standard deck of 52 playing cards and a scoring device known as a "cribbage board". The object of the game is to score points, with the first player or team of two players to reach 121 points, being declared the winner.

The points are scored in several ways throughout the game. For example, by the playing of cards alternately with the opponent, the scoring of "go" points during play, the counting of a player's hand after playing and the counting of an extra hand which the dealer has, known as the "crib". There are 2,598,960 different hand combinations and, oddly enough, the scores of 19, 25, 26 and 27 cannot be made.

Traditionally, the scoring of the game is kept on the cribbage board. This board is made of wood or plastic and usually has two tracks of 122 holes, two of these holes being the start position and a 121st hole as the win position. Each player has two "pegs", as they are called, to be moved along the track, with the back peg advancing over the front peg to add to the score. The front peg then represents the "present" score and the back peg represents the "previous" score, so that, at a glance of the board, all players know where they are in comparison to their opponents.

As scoring is continual in cribbage, this means of scoring has many disadvantages. Pegs can be lost (therefore players make their own pegs by using match sticks, nails or any other similar object which is not as effective), broken off in the board (rendering that hole unusable), or knocked off the board accidentally (leaving doubt as to the correct score). Scores can also be made in error due to the manual count of holes and when play is finished and scores are to be added, both players tend to reach for the pegs at the same time causing frustration. Also, due to the fact that the holes on a cribbage board are small and close together, it is difficult for elderly players, handicapped players or players with vision problems to score.

In an effort to eliminate these problems, some electronically operated scoreboards have been proposed, such as those disclosed by U.S. Pat. Nos. 3,189,888, 4,193,600 and 4,245,216. These all have electronic means replacing the traditional pegs but either depart largely from the traditional appearance and scoring display of cribbage, such as U.S. Pat. No. 4,193,600, or have the disadvantage that only one score indicating light per player is illuminated at a time, thus there is no indication of a "previous" score, such as in U.S. Pat. No. 3,189,888, or that the score input keys restrict the player to inputting his score in multiples of one or five, such as U.S. Pat. No. 4,245,216, or in the form of single digits, such as in U.S. Pat. No. 4,193,600.

SUMMARY OF THE INVENTION

It is accordingly an object of the present invention to provide an electronic cribbage board that avoids the disadvantages encountered with the traditional pegging board, while being faithful to the tradition, function and appearance of scoring in the game of cribbage.

Another object is to provide an electronic cribbage board that is inexpensive to produce and is battery operated and plug adaptable.

According to the invention, there is provided an electronic cribbage board, which comprises a body member; a first series of illuminable light sources on the body member for indicating the score of a first player; a second series of illuminable light sources on the body member for indicating the score of a second player, each light source by virtue of its position in each series of light sources indicating a particular score; and a keyboard for entering each player's score and which comprises a plurality of keys representing both single digit and double digit numbers and wherein each key represents a separate and different score obtainable during the play of a hand in a cribbage game, the keys being connected to the light sources by circuit means operable to illuminate an appropriate light source to visually indicate a player's score on the board.

The circuit means is preferably operable to illuminate two score-indicating light sources of each player at the same time for representing a previous score and a present score, respectively.

The circuit means may be operable, upon depression of a key of the keyboard, to illuminate a light source which is an appropriate number of places ahead of a light source indicating a present score and to switch off a light source indicating a previous score.

In a preferred embodiment two keyboards are provided at opposite ends of the body member for entering each player's score, respectively. The keyboards may be operable independently of each other for entering the player's scores. Thus, both players may enter their scores at the same time.

According to another aspect of the invention, the keyboard has 25 numbered keys, representing the numbers 1 to 18, 20 to 24, 28 and 29. Thus, any score which is obtainable during the course of the game, can be entered by the depression of a single key, thus reducing the chances of an error during scoring. The keyboard may also include a further key for cancelling an incorrect entry so that a last entry which has been made may be cancelled at any time before the next entry on the keyboard has been made.

BRIEF DESCRIPTION OF THE DRAWINGS

A preferred embodiment of the invention is described below, by way of an example, with reference to the accompanying drawings, in which.

DESCRIPTION OF PREFERRED EMBODIMENT

Figure 1:
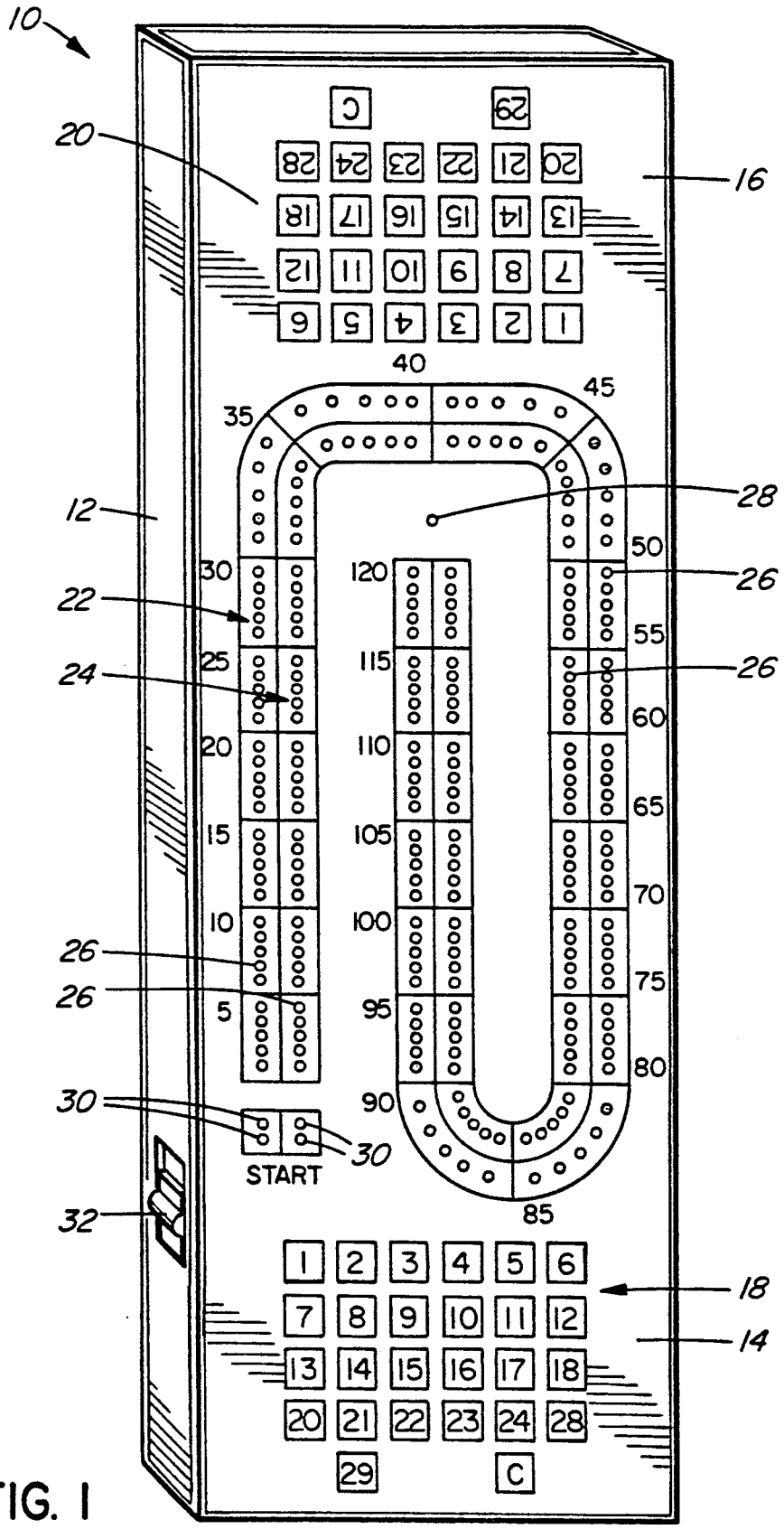
FIG. 1 is a three-dimensional view of an electronic cribbage board according to the invention.

Referring first to FIG. 1, reference numeral 10 generally indicates an electronic cribbage board which comprises an elongate body member 12 having a first player's end 14 and a second player's end 16. A first keyboard 18 is provided at the first player's end 14 and a second keyboard 20 is provided at the second player's end 16, for inputting the scores of the first and second players, respectively. Between the scoreboards 18 and 20, there are provided a first series of LED's 22 and a second series of LED's 24 for indicating the scores of the first and second players, respectively. Individual LED's are indicated by the reference numeral 26.

As can be seen, each of the series 22, 24 of LED's 26 are arranged in the form of a track and the two tracks are located next to each other. The LED's 26 are numbered in units of five, for a total of 120 LED's per track. The LED's of one track are colored red and those of the other track are colored green to represent the two players. An additional LED 28 is provided serving both players and which represents the 121st position of a winning player. A pair of LED's 30 is provided at the beginning of each track, representing the starting positions. An on/off switch 32 is provided for switching the board 10 on or off.

As can be seen from FIG. 1, the board 10 still resembles the traditional cribbage board and, instead of having holes in which pegs would be placed, the board is provided with the LED's 26 to represent the pegs. The traditional method of scoring cribbage requires each scorer to have two pegs active during the game so that the front peg represents the present score and the back peg represents the previous score. For example, if a player's front peg is located in the 10th hole and the back peg is located in the 5th hole, that would mean that the player has just scored 5 points and added this to his total to have an accumulative score of 10. After the next round of play if, for example, the player scored 7 points, the player would take his back peg and move it 7 holes in front of the front peg so that his new accumulative score would be 17.

Each of the keyboards 18 and 20 has 25 numbered keys representing the numbers from 1 to 18, 20 to 24, 28 and 29. Each keyboard also has an additional key, marked "C" which can be used to cancel an incorrect score.

In use of the board 10, the on/off switch 32 will be turned on and this will illuminate the two pairs of LED's 30 at the start position of each track. When a player needs to introduce a score on the board 10, a single one of the keys of his keyboard 18, 20 is depressed, because each possible score which can be scored is represented by a single key on the keyboard 18, 20. For example, if the first player to score, scores 5, he would depress the key representing the number 5 on his keyboard 18, 20, and the rear LED in the start position would go off and the LED in the 5 position on his track would illuminate, leaving the other LED in the start position illuminated, to now represent the "back peg". After the next play is completed and the same player should score 10 points, the LED which was illuminated in the start position would go off and the LED in the 15th position would be illuminated. Thus, the LED at the 5 position would remain illuminated, representing the "back peg" and the front LED at the 15 position would be lit, indicating the accumulated present score of 15 points.

Should an incorrect score be entered, the clear button "C" would be depressed which would turn off the front LED to return it to the back LED position which was illuminated before the score was added. This then enables the player to reenter the correct score.

At the end of the game the first player scoring 121 points is the winner. This will result in the LED 28 to be lit in either color, red or green, depending on which scorer reaches it first.

If the players decide to play a new game, the on/off switch 32 can simply be turned off and then on again which will reinstate the board to the start position with the four LED's 30 in the start position being illuminated.

The board 10 may conveniently be molded of a plastic material and be of an approximate size of 15 inches by 4 inches and may be battery operated or plug adaptable.

Figure 2:
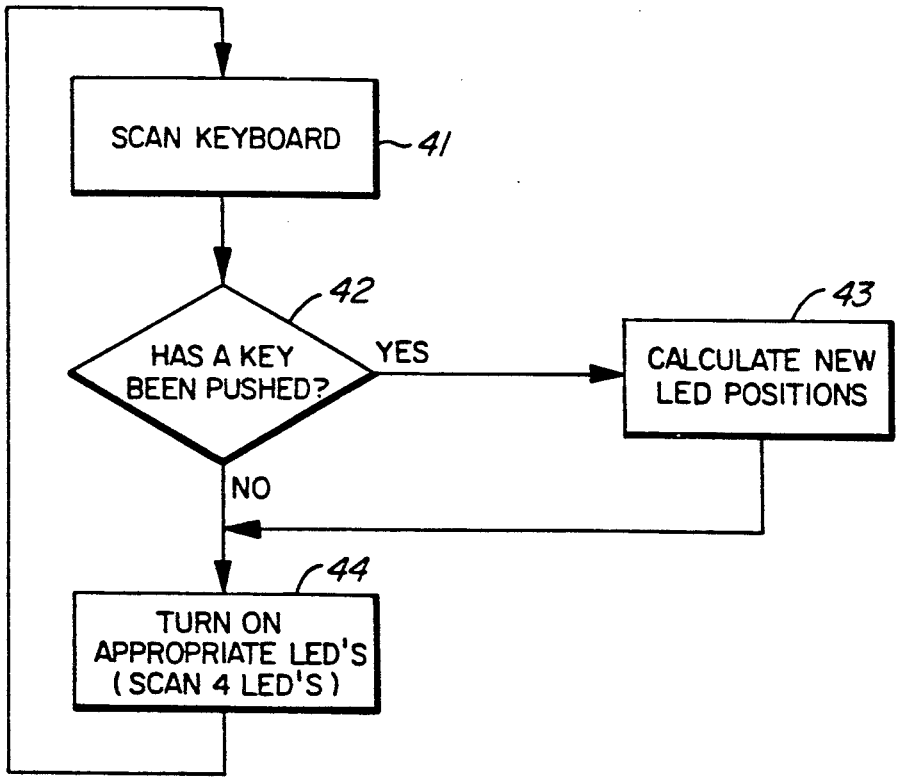
FIG. 2 is a flow chart illustrating a program suitable for controlling the operation of the board of FIG. 1.

Referring now to FIG. 2, a flow chart illustrating a program suitable for controlling the operation of the board 10 is shown. The initial function performed in the block marked 41, is that of scanning the keyboards 18 and 20. Then at 42 the program analyzes the scanned keyboard information to determine whether or not a key has been pressed. If a key has been pressed, the program goes to reference numeral 43 and takes appropriate action, such as calculating a new score. Thereafter the program goes to 44. If no key has been pressed, the program goes directly to 44. At 44 the action of illuminating and switching off the appropriate LED's 26 of each player is performed. The program then returns to the action performed at 41.

Figure 3:
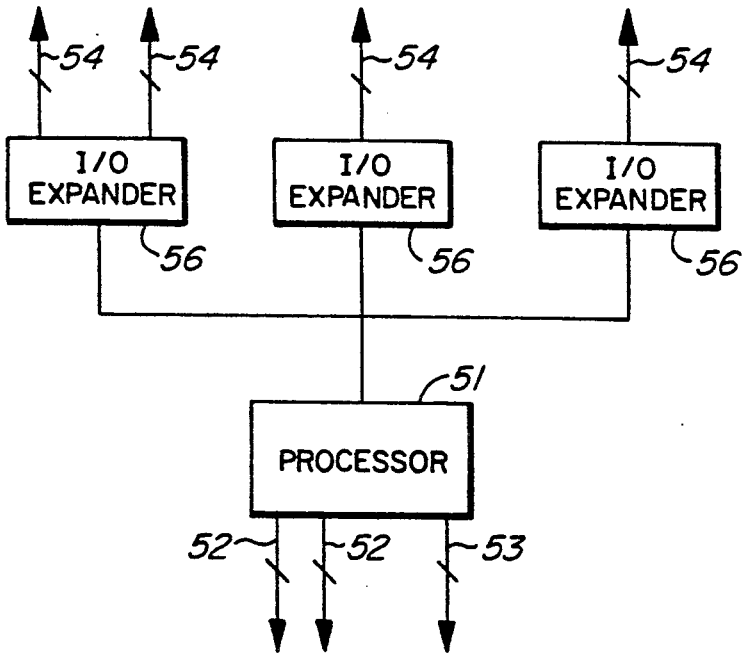
FIG. 3 is a block diagram illustrating the circuitry suitable for the operation of the board of FIG. 1.

Referring finally to FIG. 3, a block diagram illustrating the circuitry suitable for the operation of the board 10 is shown. The circuit includes a microprocessor 51 which stores and runs the control program described with reference to FIG. 2. Keyboard driver lines 52 and receiver lines 53 are provided to scan the keyboards 18 and 20 using time division multiplexing to determine which key has been pressed. LED driver lines 54 are provided to strobe the series of LED's 22 and 24 using time division multiplexing so as to simultaneously illuminate and switch off individual scoring LED's 26. Reference numerals 56 refer to in/out expanders in the LED driver lines 54 to accomplish these functions.

While only preferred embodiments of the invention have been described herein in detail, the invention is not limited thereby and modifications can be made within the scope of the attached claims.

What is claimed is:

1. An electronic cribbage board, which comprises:
an elongate body member having a first player's end and a second player's end;
a first series of illuminable light sources on the body member for indicating the score of a first player;
a second series of illuminable light sources on the body member for indicating the score of a second player, each said light source, by virtue of its position in each of the series of said light sources, indicating a particular score;
a first keyboard at the first player's end for entering the first player's score;
a second keyboard at the second player's end for entering the second player's score;
wherein each said keyboard has twenty-five numbered keys representing the numbers 1 to 18, 20 to 24, 28 and 29, the keys being connected to the light sources by circuit means operable to directly illuminate the appropriate light source, upon depression of a single one of said keys only, to visually indicate a player's score on the board.

2. The board according to claim 1, wherein the circuit means is also operable to illuminate the score indicating light source for each player representing a previous score.

3. The board according to claim 1, wherein each of said series of illuminable light sources comprises an array of 120 different positions on the board and including a further illuminable light source representing a 121st position for either of the two arrays.

4. The board according to claim 3, including an additional pair of light sources for each said array, representing starting positions.

5. The board according to claim 1, wherein the keyboards are operable independently of each other for entering the player's scores.

6. The board according to claim 1, wherein the two series of said illuminable light sources comprise two arrays of light-emitting diodes (LED's), the arrays being of different colors.

7. The board according to claim 1, wherein each of the keyboards includes a further key for cancelling an incorrect entry.

* * * * *